US005129846A

United States Patent [19]

Dimijian

[11] Patent Number: 5,129,846

[45] Date of Patent: Jul. 14, 1992

[54] VESSEL PROPULSION AND TURNING CONTROL SYSTEM

[75] Inventor: Berge A. Dimijian, 919 S. Highland Ave., Los Angeles, Calif. 90036

[73] Assignees: Berge A. Dimijian; Beverly Rodeo Development Corporation, Los Angeles, Calif. ; a part interest

[21] Appl. No.: 637,824

[22] Filed: Jan. 7, 1991

[51] Int. Cl.[5] ..... B63H 25/46

[52] U.S. Cl. ..... 440/40; 114/151

[58] Field of Search ..... 114/151; 440/38, 40, 440/43, 46; 60/221, 222

[56] References Cited

U.S. PATENT DOCUMENTS

| | | | |
|---|---|---|---|
| 120,823 | 11/1871 | McMaster . | |
| 1,023,205 | 4/1912 | Jensen . | |
| 1,197,181 | 9/1916 | Buck | 440/40 |
| 1,542,540 | 6/1925 | Zsiki | 440/38 |
| 1,694,840 | 12/1928 | Brown | 440/38 |
| 1,914,038 | 6/1933 | Ouss et al. | 440/40 |
| 2,095,031 | 10/1937 | Holmes . | |
| 2,356,301 | 8/1944 | Brase | 440/40 |
| 3,122.121 | 2/1964 | Krauth | 440/46 |
| 3,132,477 | 5/1964 | Egger . | |
| 3,279,410 | 10/1966 | Young . | |
| 3,492,965 | 2/1970 | Wayfield | 440/40 |
| 3,675,611 | 7/1972 | Glass | 440/40 |
| 3,865,067 | 2/1975 | Archer | 440/40 |
| 3,941,076 | 3/1976 | Rice | 440/40 |
| 3,942,464 | 3/1976 | Schoell . | |
| 4,138,963 | 2/1979 | Thompson | 114/151 |

*Primary Examiner*—Jesus D. Sotelo
*Attorney, Agent, or Firm*—William W. Haefliger

[57] ABSTRACT

A vessel propulsion system, the vessel having longitudinally spaced forward and rearward zones comprising a motor-driven pump having a suction inlet and a discharge outlet; two laterally spaced, forwardly directed jet openings to the vessel forward zone, and two laterally spaced, rearwardly directed jet openings at the rearward zone; structure including multiple valves in fluid path communicating between the jet openings and the pump suction inlet, and between the jet openings and the pump discharge outlet; and also between the forward and rearward jet openings, and; control structure to selectively control the valves to cause water jetting in directions to alternatively:

propel the vessel forwardly
propel the vessel rearwardly
brake vessel movement
turn the vessel to the right
turn the vessel to the left.

12 Claims, 3 Drawing Sheets (FORWARD)

(REVERSE AND BRAKING)

(TURN LEFT AND FORWARD)

(TURN RIGHT AND FORWARD)

(PIVOT CLOCKWISE)

(PIVOT COUNTER-CLOCKWISE)

VESSEL PROPULSION AND TURNING CONTROL SYSTEM

BACKGROUND OF THE INVENTION

This invention relates generally to vessel propulsion and maneuvering, and more particularly to an improved system using two pairs of eccentric jets or jet openings, and controllable valving plus a pump, to achieve all modes of vessel maneuver, including pivoting in position.

There is long-standing need for accurate and reliable vessel maneuvering in small areas, as around docks and narrow channels. Unless capability for such maneuvering is provided, collision damage to vessels, docks, etc., can occur. While prior systems using water jets have been provided, none of which I am aware affords the unusual advantages in system construction, operation and results, as are now provided.

SUMMARY OF THE INVENTION

It is a major object of the invention to provide an improved system meeting the above need. Basically, the system includes:

a) a motor-driven pump having a suction inlet and a discharge outlet, b) two laterally spaced, forwardly directed jet openings at a vessel forward zone, and two laterally spaced, rearwardly directed jet openings at a rearward zone, c) means including multiple valves in fluid path communication between the jet openings and the pump suction inlet, and between the jet openings and the pump discharge outlet; and also between the forward and rearward jet openings, and d) control means to selectively control the valves to cause water jetting in directions to alternatively:

propel the vessel forwardly
propel the vessel rearwardly
brake vessel movement
turn the vessel to the right
turn the vessel to the left.

As will be seen, the multiple valves may be ten in number to accomplish all of the above maneuvers.

It is another object of the invention to provide two like sets of four valves each, one set operatively connected in fluid paths between the two forward jet openings and the pump inlet and outlet; and the other set operatively connected in fluid paths between the two rearward jet openings and the pump inlet and discharge outlet. One such set may include first and second pairs of valves, the valves of the first pair respectively connected with the two forward jet openings and the valves of the second pair respectively connected with the pump inlet and outlet, and there being a common fluid path connection between the valves of the first and second pairs. The other set may include third and fourth pairs of valves, the valves of the third pair respectively connected with the two second jet openings, and the valves of the fourth pair respectively connected with the pump inlet and outlet, and there being a common fluid path connection between the valves of the third and fourth pairs. Also, one of the valves of the second pair and one of the valves of the fourth pair have a common fluid path connection with the pump inlet; and the other of the valves of the second pair and the other of the valves of the fourth pair have a common fluid path connection with the pump discharge outlet.

Further, the two forward jet openings are at opposite sides of a longitudinal vertical plane bisecting the vessel, and the two rearward jet openings are also at opposite sides of that plane; and including a first additional valve having direct fluid path connection between a forward jet opening at one side of the plane, and a rearward jet opening at the other side of the plane, and a second additional valve having direct fluid path connection between a forward jet opening at the other side of the plane, and a rearward jet opening at the one side of the plane.

It is another object to provide a four jet system wherein two forward jet openings at opposite sides of a longitudinal vertical plane bisecting the vessel have equal lateral openings therefrom; and the two rearward jet openings a opposite sides of the vertical plane have equal lateral spacings therefrom.

These and other objects and advantages of the invention, as well as the details of an illustrative embodiment, will be more fully understood from the following specification and drawings, in which:

DRAWING DESCRIPTION

DETAILED DESCRIPTION

Figure 1:
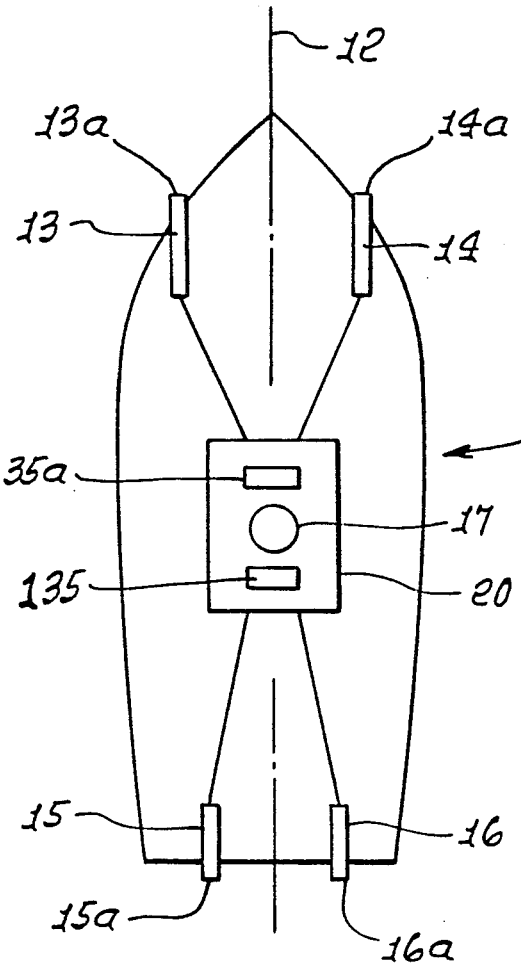
FIG. 1 is a top plan view showing a vessel incorporating the invention.
Figure 2:
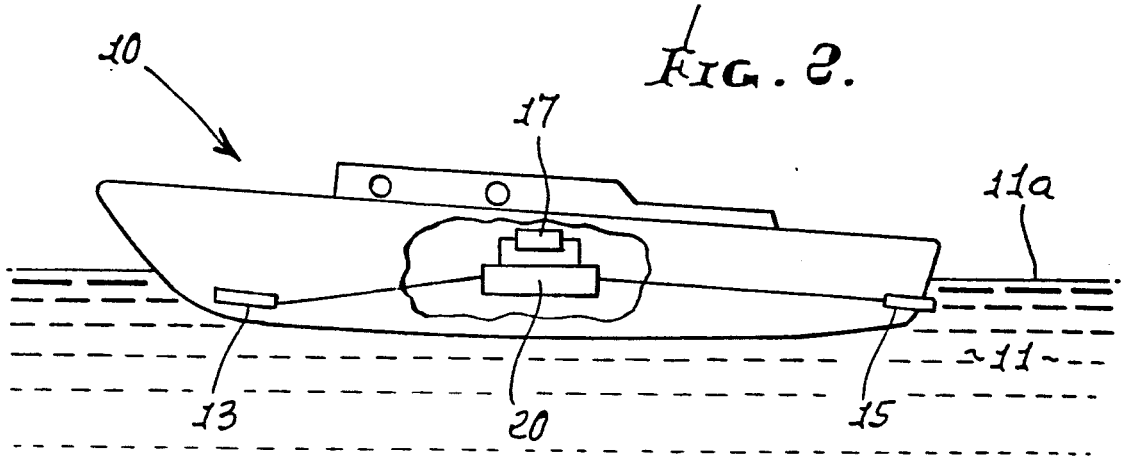
FIG. 2 is a side elevational view of the FIG. 1 vessel.

In FIGS. 1 and 2, a vessel 10 is to be maneuvered on a water body 11. A longitudinal, upright plane 12 bisects the vessel. On the vessel are two laterally spaced, forwardly directed like jets 13 and 14 having forwardly facing jet openings 13*a* and 14*a*. Those jets are located at opposite sides of plane 12, i.e, eccentrically relative to that plane which typically passes through the center of gravity of the vessel. Also carried on the vessel are two laterally spaced, rearwardly directed like jets 15 and 16 having two rearwardly directed jet openings 15*a* and 16*a*. Those two jets are located at opposite sides of plane 12, i.e., eccentrically relative to that plane, and below the water body surface 11*a*.

Jet openings 13*a* and 14*a* are equally spaced from plane 12, as are jet openings 15*a* and 16*a*. Control of vessel propulsion direction and turning is achieved by control of water intake and discharge to and from those four openings.

A motor-driven pump 17 is provided on the vessel to provide suction for water intake via selected jet openings, and pressure for water discharge via selected jet openings. If water is sucked in via 13 and 14, and discharged at equal rates via 15 and 16, the vessel moves forwardly (see FIG. 3); and if water is sucked in via 15 and 16 and discharged at equal rates via 13 and 14, the vessel moves rearwardly (see FIG. 4). Also, if water is sucked in at 13 and discharged at 16 at a relatively high rate, and water is sucked in 14 and discharged at 15 at a relatively low rate, the vessel moves forwardly and leftwardly (see FIG. 5); and if water is sucked in at 14 and discharged at 15 at a relatively high rate, and water is sucked in at 13 and discharged at 16 at a relatively low rate, the vessel moves forwardly and rightwardly (see FIG. 6). Also, if water is sucked in at 13 and 16, and discharged at 15, the vessel pivots clockwise (see FIG.

Figure 8:
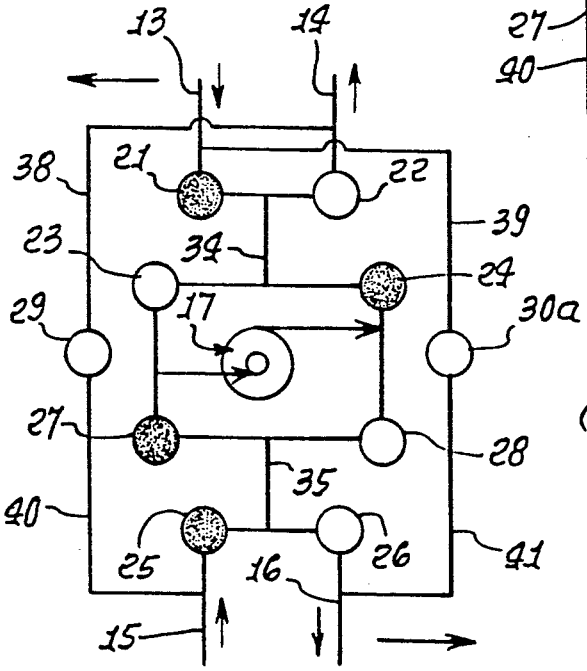

7); and if water is sucked in at 14 and 15 and discharged at 16, the vessel pivots counterclockwise (see FIG. 8).

FIG. 2 shows valving, generally indicated at 20, connected in flow paths between jets 13–16, and the pump 17, to control such intake and discharge via the jets, as referred to.

Extending the description to FIGS. 3–8, valves 21–30*a* are shown. Each valve has inlet and outlet openings, connected in series with the flow paths as shown. At times, a particular valve opening may serve as an inlet, and at other times as an outlet, depending upon the direction of water flow through the valve.

Flow paths are indicated as follows:

| Flow path | Descriotion |
|---|---|
| 30 | between valve 21 and jet opening 13a |
| 31 | between valve 22 and jet opening 14a |
| 32 | between valve 25 and jet opening 15a |
| 33 | between valve 26 and jet opening 16a |
| 34 | common to valves 21–24 |
| 35 | common to valves 25–28 |
| 36 | common to valves 23 and 27, and to pump suction inlet 17a |
| 37 | common to valves 24 and 28, and to pump discharge outlet 17b |
| 38 | between one side of valve 29 and jet opening 14a |
| 39 | between one side of valve 30 and jet opening 13a |
| 40 | between the other side of valve 29 and jet opening 15a |
| 41 | between the other side of valve 30a and jet opening 16a. |

Figure 3:
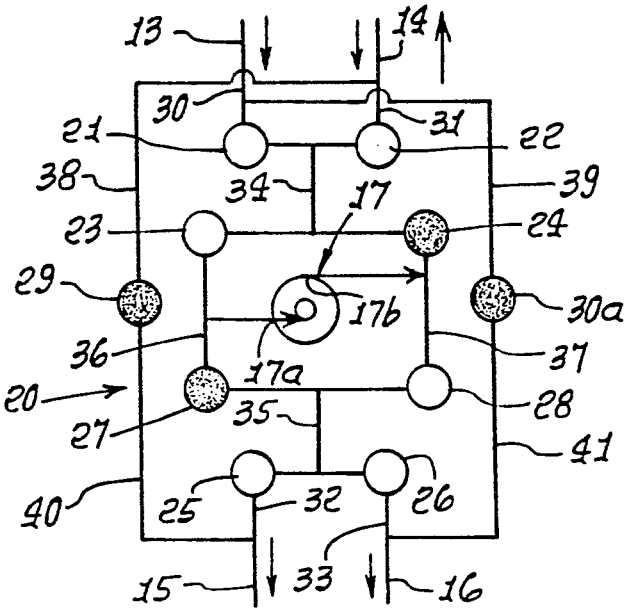
FIGS. 3–8 are schematic views showing fluid path connection between jet openings, pump and valves.
Figure 4:
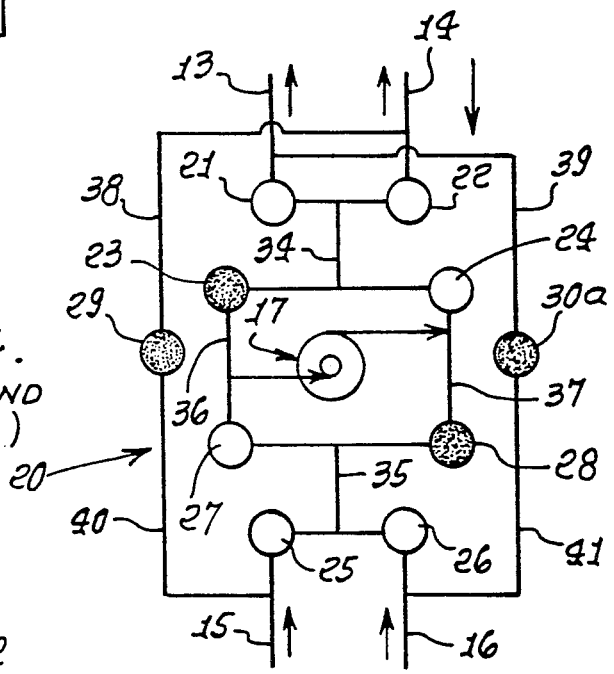
Figure 5:
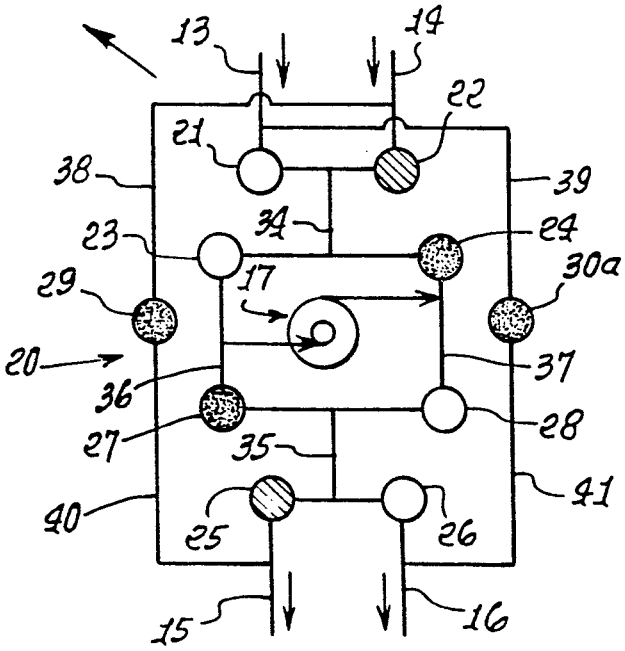

The valves may be suitably opened or closed, as by a controller 135 operating actuators associated with the valves, the controller for example establishing open or shut condition of the valves as are seen in FIGS. 3–8. Also, the controller controls the condition of a drive 35*a* for the pump (on, off, or at selected speed control, to establish vessel travel or such speed control). In the views 3–8, the circle indicating each valve is white (valve open) or dark (valve closed) or shaded (valve partly open, as for example half open). For example, in FIG. 3, valves 21–23, 25, 26, and 28 are open, and all other valves are closed. In FIG 5, valves 21, 23, 26, and 28 are open; valves 24, 27, 29, and 30*a* are closed; and valves 22 and 25 are partly open.

Accordingly, in accordance with the invention, there are two like sets of valves, one set (21–24) operatively connected in fluid paths between the two forward jet openings and the pump inlet outlet; and the other set (25–28) operatively connected in fluid paths between the two rearward jet openings and the pump inlet and discharge outlet.

The two valves 21 and 22 of a first pair (of the first set) are respectively connected with jet openings 13*a* and 14*a* and the two valves 23 and 24 of a second pair (of the first set) are respectively connected with the pump inlet and outlet (17*a* and 17*b*). Also, the two valves 25 and 26 of a third pair (of the second set) are respectively connected with rear jet openings 15*a* and 16*a;* and the two valves 27 and 28 of a fourth pair (of the second set) are respectively connected with the pump inlet and outlet.

Common fluid path 34 connects the valves of the first set; and common fluid path 35 connects the valves of the second set. Further, one of the valves of each set (valves 23 and 27) has common fluid connection 36 with the pump inlet; and another of the valve of each set (valves 24 and 28) has a common fluid connection 37 with the pump outlet.

Also, the valves 29 and 30*a* may be regarded as first and second additional valves. Valve 29 has a direct fluid path connection between a forward jet opening at one side of the plane, and a rearward jet opening at the other side of the plane, and a second additional valve 30 having direct fluid path connection between a forward jet opening at the other side of the plane, and a rearward jet opening at the one side of the plane.

In operation, and as seen in FIG. 3, pump takes suction from forward jet openings 13*a* and 14*a*, via valves 21, 22 and 23, and discharges water under pressure from jet openings 15*a* and 16*a*, via valves 28, 25 and 26. This propels the vessel forwardly.

In FIG. 4, valves 21, 22, 24, 25, 26, and 27 are now open and water is pumped from 15*a* and 16*a* to 13*a* and 14*a* to propel the boat in reverse, or brakes forward propulsion.

In FIG. 5, valves 21, 23, 26, and 28 are open, and valves 22 and 25 are partly (say half) closed. This causes the vessel to move forwardly and rightwardly (all other valves are closed).

Figure 6:
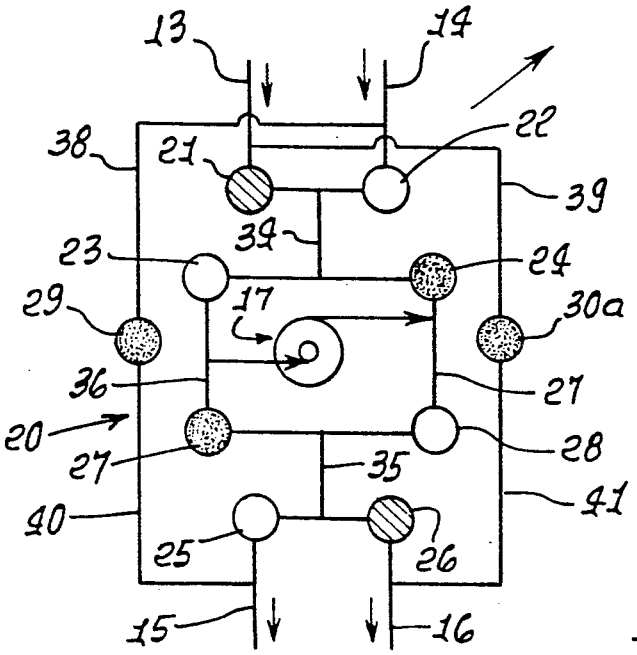

In FIG. 6, valves 22, 23, 25, and 28 are open, and valves 21 and 26 are partly closed. All others are closed. The vessel therefore moves forwardly and leftwardly.

Figure 7:
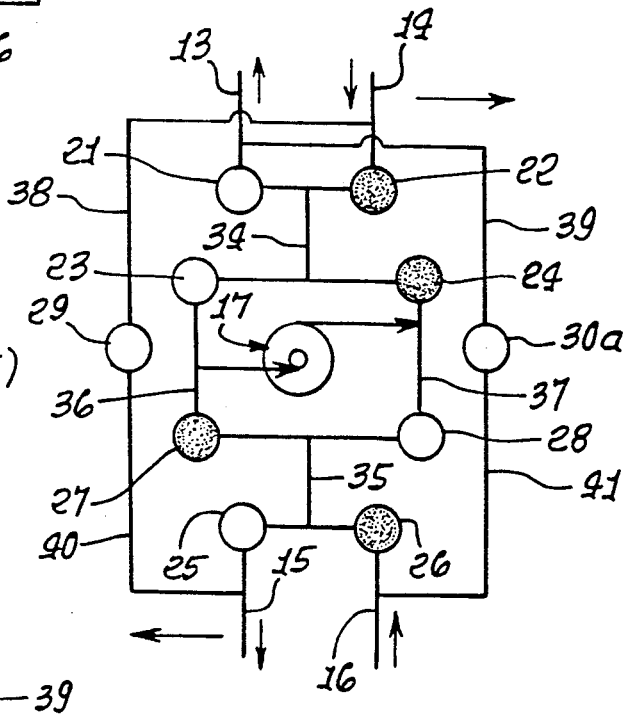

In FIG. 7, valves 21, 23, 25, 28, 29, and 30*a* are open, and all others closed. The vessel therefore pivots clockwise.

In FIG. 8, valves 22, 23, 26, 28, 29, and 30*a* are open, and all others closed. This causes counterclockwise pivoting.

Accordingly, an exceedingly simple, efficient vessel maneuvering system is provided, having multiple modes of operation, as follows:

forward
rearward and/or braking of forward
forward and to left
forward and to right
rearward and to left
rearward and to right
clockwise pivoting
counterclockwise pivoting.

I CLAIM:

1. In a vessel propulsion system, the vessel having longitudinally spaced forward and rearward zones, the combination comprising:

a) a motor-driven pump having a suction inlet and a discharge outlet, b) two laterally spaced, forwardly directed jet openings to said vessel forward zone, and two laterally spaced, rearwardly directed jet openings at said rearward zone, c) means including multiple valves in fluid path communicating between said jet openings and said pump suction inlet, and between said jet openings and said pump discharge outlet; and also between the forward and rearward jet openings, and d) control means to selectively control said valves to cause water jetting in directions to alternatively
propel the vessel forwardly
propel the vessel rearwardly
brake vessel movement
turn the vessel to the right
turn the vessel to the left.

2. The combination of claim 1 wherein there are 10 of said valves.

3. The combination of claim 1 wherein one of said valves is in a fluid path between the left forward jet opening and the right rearward jet opening, and another of said valves is in a fluid path between the right forward jet opening and the left rearward jet opening.

4. The combination of claim 1 wherein two of said valves are respectively connected between said two formed jet openings and a common fluid path, and another two of said valves are respectively connected between said two rearward jet openings and a common fluid path.

5. The combination of claim 1 wherein there are two like sets of valves, one set operatively connected in fluid paths between said two forward jet openings and said pump inlet and outlet; and the other set operatively connected in fluid paths between said two rearward jet openings and said pump inlet and discharge outlet.

6. The combination of claim 5 wherein one set includes first and second pairs of valves, the valves of the first pair respectively connected with the two forward jet openings and the valves of the second pair respectively connected with the pump inlet and outlet, and there being a common fluid path connection between the valves of the first and second pairs.

7. The combination of claim 5 wherein the other set includes first and second pairs of valves, the valves of the first pair respectively connected with the two rearward jet openings, and the valves of the second pair respectively connected with the pump inlet and outlet, and there being a common fluid path connection between the valves of the first and second pairs.

8. The combination of claim 6 wherein the other set includes third and fourth pairs of valves, the valves of the third pair respectively connected with the two rearward jet openings, and the valves of the fourth pair respectively connected with the pump inlet and outlet, and there being a common fluid path pairs.

9. The combination of claim 8 wherein one of the valves of the second pair and on of the valves of the fourth pair have a common fluid path connection with the pump inlet.

10. The combination of claim 9 wherein the other of the valves of the second pair and the other of the valves of the fourth pair have a common fluid path connection with the pump discharge outlet.

11. The combination of claim 1 wherein the two forward jet openings are at opposite sides of a longitudinal vertical plane bisecting the vessel, and the two rearward jet openings are also at opposite sides of said plane, and including a first additional valve having direct fluid path connection between a forward jet opening at one side of said plane, and a rearward jet opening at the other side of said plane, and a second additional valve having direct fluid path connection between a forward jet opening at said other side of said plane, and a rearward jet opening at said one side of said plane.

12. The combination of claim 1 wherein the two forward jet openings are at opposite sides of a longitudinal vertical plane bisecting the vessel have equal lateral spacings therefrom; and the two rearward jet openings are at opposite sides of said vertical plane and have equal lateral spacings therefrom.

* * * * *